US010923253B1

(12) United States Patent
Park et al.

(10) Patent No.: US 10,923,253 B1
(45) Date of Patent: Feb. 16, 2021

(54) RESISTOR COMPONENT

(71) Applicant: SAMSUNG ELECTRO-MECHANICS CO., LTD., Suwon-si (KR)

(72) Inventors: Gwang Hyeon Park, Suwon-si (KR); Ji Sook Yoon, Suwon-si (KR); Ah Ra Cho, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/869,927

(22) Filed: May 8, 2020

(30) Foreign Application Priority Data

Dec. 30, 2019 (KR) ..... 10-2019-0178324

(51) Int. Cl.

| | |
|---|---|
| ***H01C 17/242*** | (2006.01) |
| ***H01C 1/012*** | (2006.01) |
| ***H01C 17/065*** | (2006.01) |
| ***H01C 7/00*** | (2006.01) |
| ***H01C 1/142*** | (2006.01) |

(52) U.S. Cl.
CPC ..... *H01C 17/242* (2013.01); *H01C 1/012* (2013.01); *H01C 1/142* (2013.01); *H01C 7/003* (2013.01); *H01C 17/065* (2013.01)

(58) Field of Classification Search
CPC ..... H01C 17/065; H01C 1/012; H01C 1/142; H01C 7/003
See application file for complete search history.

(56) References Cited

U.S. PATENT DOCUMENTS 4,197,521 A * 4/1980 Rovnyak ..... H01C 7/13 338/195
4,434,416 A * 2/1984 Schonberger ..... H01C 7/04 338/22 R (Continued)

FOREIGN PATENT DOCUMENTS

JP H09-205004 A 8/1997
JP 2011-223029 A 11/2011

(Continued)

OTHER PUBLICATIONS

Office Action issued in corresponding Korean Patent Application No. 10-2019-0178324 dated Dec. 4, 2020, with English translation.

*Primary Examiner* — Kyung S Lee
(74) *Attorney, Agent, or Firm* — Morgan, Lewis & Bockius LLP

(57) ABSTRACT

A resistor component includes a support substrate, a resistive layer disposed on one surface of the support substrate, and a plurality of slits disposed in the resistive layer, each extending from one end or another end of the resistive layer opposing each other in a first direction, and spaced apart from each other in a second direction traversing the first direction. First and second internal electrodes are disposed on the support substrate and are respectively disposed on one end and another end of the resistive layer opposing each other in the second direction to be spaced apart from each other. A first protective layer is disposed on the resistive layer. The plurality of slits include a primary slit covered by the first protective layer, and a secondary slit extending in the first protective layer.

20 Claims, 6 Drawing Sheets

(56) References Cited

U.S. PATENT DOCUMENTS

| | | | | |
|---|---|---|---|---|
| 5,990,781 | A * | 11/1999 | Kambara | H01C 1/012 338/309 |
| 6,084,502 | A * | 7/2000 | Ariga | H01C 17/06 338/195 |
| 6,304,167 | B1 | 10/2001 | Nakayama | |
| 8,432,247 | B2 * | 4/2013 | Wang | H02H 9/026 338/195 |
| 9,460,834 | B2 * | 10/2016 | Croci | G01L 9/0052 |
| 9,704,621 | B2 * | 7/2017 | Ogawa | H01C 1/142 |
| 2004/0113750 | A1 | 6/2004 | Matsukawa et al. | |
| 2005/0275503 | A1 * | 12/2005 | Yoneda | H01C 17/006 338/309 |
| 2009/0040011 | A1 * | 2/2009 | Yoneda | H01C 1/012 338/309 |
| 2009/0237200 | A1 | 9/2009 | Yoneda | |
| 2016/0118164 | A1 * | 4/2016 | Fukao | H01C 17/065 338/287 |

FOREIGN PATENT DOCUMENTS

| | | | |
|---|---|---|---|
| KR | 10-2001-0014285 | A | 2/2001 |
| KR | 10-2003-0088496 | A | 11/2003 |
| KR | 10-2008-0043268 | A | 5/2008 |

* cited by examiner

RESISTOR COMPONENT

CROSS-REFERENCE TO RELATED APPLICATION(S)

This application claims benefit under 35 USC 119(a) of Korean Patent Application No. 10-2019-0178324 filed on Dec. 30, 2019 in the Korean Intellectual Property Office, the entire disclosure of which is incorporated herein by reference for all purposes.

BACKGROUND

1. Field

The present disclosure relates to a resistor component.

2. Description of Related Art

Resistor components are passive electronic components for implementing precision resistors, and serve to regulate current and drop voltage in electronic circuits.

In the case of a general resistor component, a resistance value is precisely controlled by forming a slit in a resistive layer in a trimming process. Such a slit may be formed in the resistive layer after applying a resistive layer paste to a support substrate and sintering the resistive layer. In this case, the surface of the periphery of the slit in the resistive layer is relatively uneven due to the fluidity of the resistive layer paste and diffusion and grain growth during sintering.

In addition, such slits may also be formed in a protective layer after sintering the protective layer formed on the resistive layer. In this case, fine cracks may occur in the periphery of the slit in the protective layer by a glass component included in the protective layer.

Such cracks may not only be an inhibitory factor in controlling the resistance value of the resistive layer, but may also be a factor in weakening the withstand voltage characteristics of resistor components.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

An aspect of the present disclosure is to provide a resistor component in which a resistance value may be controlled more precisely.

An aspect of the present disclosure is to provide a resistor component in which withstand voltage characteristics may be improved.

According to an aspect of the present disclosure, a resistor component includes a support substrate, a resistive layer disposed on one surface of the support substrate, and a plurality of slits disposed in the resistive layer, each extending from one end or another end of the resistive layer opposing each other in a first direction, and spaced apart from each other in a second direction traversing the first direction. First and second internal electrodes are disposed on the support substrate and respectively disposed on one end and another end of the resistive layer opposing each other in the second direction to be spaced apart from each other. A first protective layer is disposed on the resistive layer. The plurality of slits include a primary slit covered by the first protective layer, and a secondary slit extending into the first protective layer.

According to an aspect of the present disclosure, a resistor component includes a support substrate, a resistive layer disposed on one surface of the support substrate, and having a plurality of slits extending therethrough, and a first protective layer disposed on the resistive layer and extending in at least one slit of the plurality of slits. At least another slit of the plurality of slits is free of the first protective layer therein.

BRIEF DESCRIPTION OF THE DRAWINGS

The above and other aspects, features, and advantages of the present disclosure will be more clearly understood from the following detailed description, taken in conjunction with the accompanying drawings, in which.

DETAILED DESCRIPTION

Figure 1:
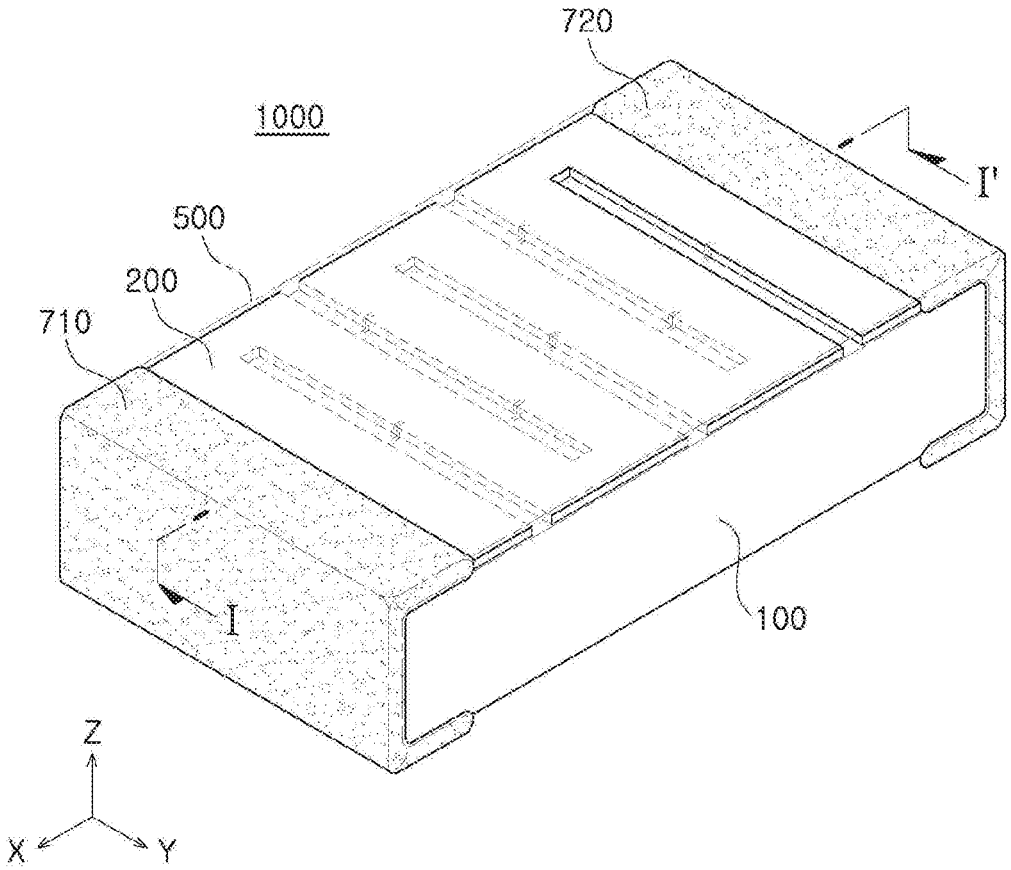
FIG. 1 is a view schematically illustrating a resistor component according to an exemplary embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and the disclosure is not limited to those set forth herein, but may be changed as will be apparent to one of ordinary skill in the art, with the exception of operations necessarily occurring in a certain order. Also, descriptions of functions and constructions that would be well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will fully convey the scope of the disclosure to one of ordinary skill in the art.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there may be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's positional relationship to another element in the orientation illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes illustrated in the drawings may occur. Thus, the examples described herein are not limited to the specific shapes illustrated in the drawings, but include changes in shape that may occur during manufacturing.

The various features of the examples described herein may be combined in various ways as will be apparent based on an understanding of the disclosure of this application. Further, although the examples described herein have a variety of configurations, other configurations are possible as will be apparent after an understanding of the disclosure of this application.

The drawings may not be to scale, and the relative size, proportions, and depiction of elements in the drawings may be exaggerated for clarity, illustration, and convenience.

In addition, combinations of components may include cases in which respective components are physically indirect contact with each other in a contact relationship between the respective components, and also cases in which other components are interposed between the respective components to be in direct contact with each other.

Since the size and thickness of each component illustrated in the drawings are arbitrarily illustrated for convenience of description, the present disclosure is not necessarily limited to what is illustrated.

In the drawings, a Y direction may be defined as a first direction or a width direction, an X direction as a second direction or a length direction, and a Z direction as a third direction or a thickness direction.

Hereinafter, a resistor component according to an exemplary embodiment will be described in detail with reference to the accompanying drawings, and in the description with reference to the accompanying drawings, identical or corresponding components are assigned the same reference numbers, and overlapped descriptions thereof will be omitted.

Embodiment

Figure 2:
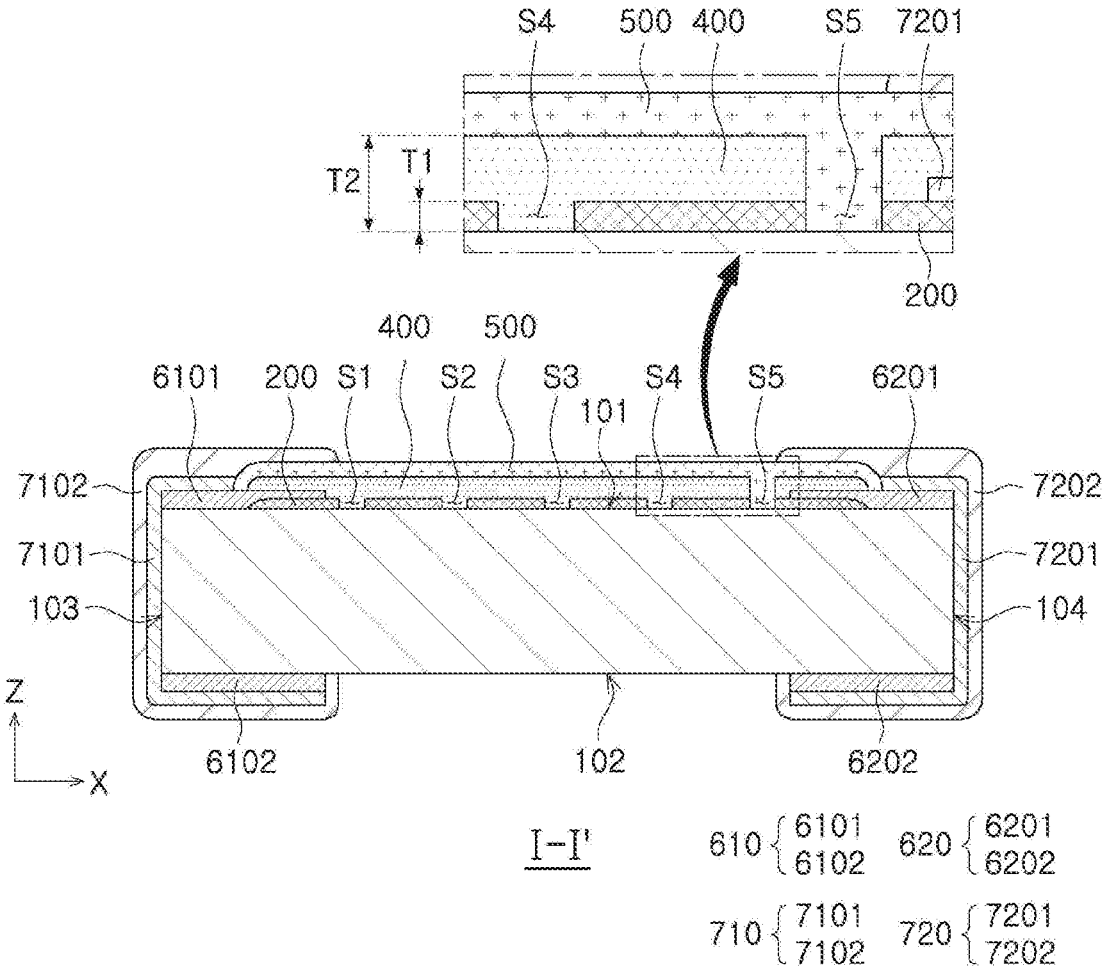
FIG. 2 schematically illustrates a cross section taken along line I-I' in FIG. 1.
Figure 3:
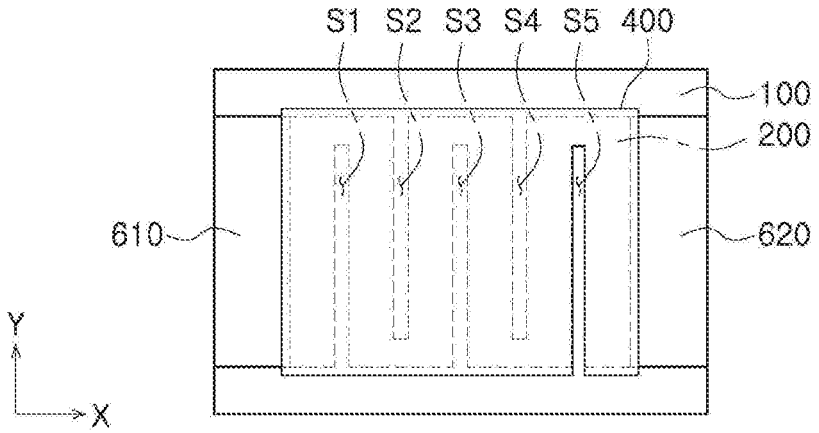
FIG. 3 is a plan view schematically illustrating a resistor component according to an exemplary embodiment.

FIG. 1 is a view schematically illustrating a resistor component according to an exemplary embodiment. FIG. 2 is a view schematically illustrating a cross section taken along line I-I' of FIG. 1. FIG. 3 is a plan view schematically illustrating a resistor component according to an exemplary embodiment. FIGS. 4A to 4F are views schematically illustrating a process of manufacturing a resistor component according to an exemplary embodiment. On the other hand, for convenience of description, a first protective layer is omitted in the illustration of FIG. 1, and a second protective layer and first and second external electrode layers are omitted in the illustration of FIG. 3.

Referring to FIGS. 1 to 3, a resistor component 1000 according to an exemplary embodiment includes a support substrate 100, a resistive layer 200, slits S1, S2, S3, S4 and S5, first and second internal electrodes 610 and 620, and a first protective layer 400.

In this embodiment, the support substrate 100 supports the resistive layer 200 and secures the strength of the resistor component 1000. In this embodiment, one surface of the support substrate 100 refers to a first surface 101. Referring to FIG. 2, the support substrate 100 includes the first surface 101 and a second surface 102 opposing each other in a thickness direction Z, and a third surface 103 and a fourth surface 104 connecting the first and second surfaces to each other and opposing each other in a longitudinal direction X. Although not specifically illustrated, the support substrate 100 may further include a fifth surface and a sixth surface opposing each other in a width direction Y while connecting and abutting the first surface 101 to the fourth surface 104.

The support substrate 100 may be provided in a plate shape having a predetermined thickness, and may include a material capable of efficiently dissipating heat generated in the resistive layer 200 to be described later. The support substrate 100 may include a ceramic material such as alumina ($Al_2O_3$), but the material of the support substrate 100 is not limited thereto. For example, the support substrate 100 may also include a polymer material. For example, the support substrate 100 may be an alumina support substrate obtained by anodizing the surface of aluminum, but an embodiment thereof is not limited thereto. For example, the support substrate 100 may be a sintered alumina substrate.

The resistive layer 200 is disposed on one surface of the support substrate 100 and has one end and another end opposing each other in the first direction Y. In addition, the resistive layer 200 has a second direction X traversing the first direction Y. The first direction Y and the second direction X may be perpendicular to each other, but embodiments thereof are not limited thereto.

The resistive layer 200 is respectively connected to the first and second internal electrodes 610 and 620, which will be described later, disposed on the support substrate 100, thereby exerting the function of the resistor component 1000 according to this embodiment. The resistive layer 200 may have regions overlapping with the first internal electrode 610 and the second internal electrode 620.

A distance between one end and the other end of the resistive layer 200, opposing each other in the first direction Y, may be the same as the length of the support substrate 100 in the first direction Y. In this case, it may be advantageous in that the area of the resistive layer 200 may be maximized or appropriately secured. In addition, the resistive layer 200 may be collectively formed on multiple unit substrates connected to each other on a strip substrate or a panel substrate, and thus, forming the resistive layer 200 to extend across the full support substrate in the first direction Y may have advantages in terms of a manufacturing process efficiency.

The resistive layer 200 may include metal, a metal alloy, or a metal oxide. In detail, the resistive layer 200 may include Ag, Pd, Cu, Ni, a Cu—Ni-based alloy, a Ni—Cr-based alloy, a Ru oxide, a Si oxide, Mn, and/or a Mn-based alloy as main components. The resistive layer 200 may include a metal formed of silver (Ag), palladium (Pd), or an alloy thereof, depending on a required resistance value, or may include a Ru oxide and a Si oxide.

Referring to FIG. 2, the resistive layer 200 may be formed by applying a conductive paste containing a metal, a metal alloy, a metal oxide, or the like to the first surface 101 of the support substrate 100 by a method such as screen printing, to then be sintered.

The first and second internal electrodes 610 and 620 may be spaced apart from each other on the support substrate 100 to face each other in the second direction X and each traversing or extending across the first direction Y. The first internal electrode 610 and the second internal electrode 620 are connected to respective ends of the resistive layer 200.

Referring to FIG. 2, the first internal electrode 610 and the second internal electrode 620 respectively include first and third internal electrode layers 6101 and 6201 disposed on one end and the other end of the first surface 101 of the support substrate 100, opposing each other in the second direction X, to be spaced apart from each other, and connected to the resistive layer 200. In addition, the first internal electrode 610 and the second internal electrode 620 may further respectively include second and fourth internal electrode layers 6102 and 6202 spaced apart from each other on one end and the other end of the second surface 102 of the support substrate 100 opposing each other in the second direction X. The first and second internal electrode layers 6101 and 6102 are electrically connected to each other by a first external electrode layer 7101 formed on the third surface 103 of the support substrate 100 and partially extending to the first surface 101 and the second surface 102 of the support substrate 100, as will be described later. In addition, the third and fourth internal electrode layers 6201 and 6202 are electrically connected to each other by a second external electrode layer 7201 formed on the fourth surface 104 of the support substrate 100 and partially extending to the first surface 101 and the second surface 102 of the support substrate 100.

The first and second internal electrodes 610 and 620 may be formed by printing or coating a conductive paste on the first surface 101 and the second surface 102 of the support substrate 100 and then sintering the conductive paste. The conductive paste for the formation of the first and second internal electrodes 610 and 620 may include a metal powder such as copper (Cu), silver (Ag), nickel (Ni) or the like, a binder, and a glass component. Accordingly, the first and second internal electrodes 610 and 620 may include glass and metal components.

The first and second external electrodes 710 and 720 may be formed by, for example, vapor deposition such as sputtering, plating, paste printing or the like. When the first and second external electrodes 710 and 720 are formed by a plating method, although not illustrated, a seed layer for the plating formation of the first and second external electrodes 710 and 720 may be formed on the third surface 103 and the fourth surface 104, respectively, of the support substrate 100. The seed layer may be formed by an electroless plating method, a vapor deposition method such as sputtering, or a printing method. The first and second external electrodes 710 and 720 may include at least one of titanium (Zi), chromium (Cr), molybdenum (Mo), copper (Cu), silver (Ag), nickel (Ni), tin (Sn), and alloys thereof.

Referring to FIG. 2, the first and second external electrodes 710 and 720 may be formed of a plurality of layers including first to fourth external electrode layers 7101, 7201, 7102 and 7202. For example, the first external electrode 710 includes the first external electrode layer 7101 disposed on the third surface 103 of the support substrate 100 and extending to the first surface 101 and the second surface 102 of the support substrate 100 to cover portions of the first and third internal electrode layers 6101 and 6102. In addition, the first external electrode 710 may further include the third external electrode layer 7102 formed on the first external electrode layer 7101 and extending to the first surface 101 and the second surface 102 of the support substrate 100 to cover portions of a second protective layer 500 to be described later. The first external electrode layer 7101 may be a sputtering layer including a metal such as copper (Cu), chromium (Cr), or nickel (Ni), or an electroplating layer formed by electroplating. The third external electrode layer 7102 formed on the first external electrode layer 7101 may be an electroplating layer including tin (Sn), but an embodiment thereof is not limited thereto.

A first protective layer 400 is disposed on the resistive layer 200 to protect the resistive layer 200 from external impacts. In detail, after forming primary slits S1, S2, S3 and S4, to be described later, on the resistive layer 200, the first protective layer 400 may be disposed on the first surface 101 of the support substrate 100 to cover the resistive layer 200 to protect the resistive layer 200. As a result, referring to FIG. 2, the first protective layer 400 may be disposed on inner walls of the primary slits S1, S2, S3 and S4, and may be disposed inside the primary slits S1, S2, S3 and S4 to be in contact with the first surface 101 of the support substrate 100 through the primary slits S1, S2, S3, and S4. In addition, referring to FIG. 2, the first protective layer 400 is disposed on the first and second internal electrodes 610 and 620 to cover portions of the first and second internal electrodes 610 and 620. The first protective layer 400 may be formed of a material containing silicon ($SiO_2$) or glass to protect the resistive layer 200 in the process of forming the slits (S1, S2, S3, S4 and S5) in the resistive layer 200.

The second protective layer 500 may be disposed on the first protective layer 400 to protect the resistive layer 200 in which secondary slit S5 is formed to expose a portion of the resistive layer 200 and to protect the support substrate 200 in which a portion of the first surface 101 is exposed. For example, referring to FIG. 2, the second protective layer 500 is disposed on the first protective layer 400 to cover the secondary slit S5. The second protective layer 500 may be formed of a material containing a resin.

In the resistive layer 200, a plurality of slits S1, S2, S3, S4, and S5 extending in the first direction Y and spaced apart from each other are formed. In this embodiment, the direction in which the primary slits S1, S2, S3 and S4 and the secondary slit S5 extend may be parallel to the first direction Y. Referring to FIG. 3, the primary slits (S1, S2, S3, S4) include: one end slits S1 and S3 extending from one end toward the other end (but without extending all the way to the other end) in the first direction Y; and the other end slits S2 and S4 extending from the other end toward one end (but without extending all the way to the one end) in the first direction Y and formed alternately with the one end slits S1 and S3 toward the other end from one end in the second direction X. In addition, the secondary slit S5 is spaced apart from the primary slits S1, S2, S3 and S4 to be disposed on one end or the other end in the second direction X. Referring to FIG. 3, the secondary slit S5 is formed on the other end side in the first direction Y to be adjacent to the primary slit S4 formed on the other end side in the second direction X. On the other hand, based on the first direction Y, the one-end side primary slits S1 and S3 and secondary slits S5 formed in the resistance layer 200 do not extend to the other end of the resistive layer 200 in the Y direction, and the other end-side primary slits S2 and S4 formed in the resistive layer 200 do not extend to the one end of the resistive layer 200 in the Y direction. As a result, the resistive layer 200 is formed in a serpentine pattern as a whole.

The primary slits S1, S2, S3 and S4 may increase the total length of the resistive layer 200 to improve the withstand voltage characteristics of the resistor component 1000 according to this embodiment. For example, by forming the primary slits S1, S2, S3 and S4 in the resistive layer 200 within a limited area, the total length of the resistive layer 200 may be increased. As a result, even in the case in which the same overvoltage is applied between the first and second internal electrodes 610 and 620, the resistor component 1000 according to this embodiment has improved withstand voltage characteristics, compared with a general resistor component in which a slit is not formed in a resistive layer.

The primary slits S1, S2, S3 and S4 may be formed by printing a paste for the formation of the resistive layer 200 on the first surface 101 of the support substrate 100 to then be sintered and then by removing a portion of the resistive layer 200 in the position of the primary slits S1-S4 through an additional process.

Figure 4A:
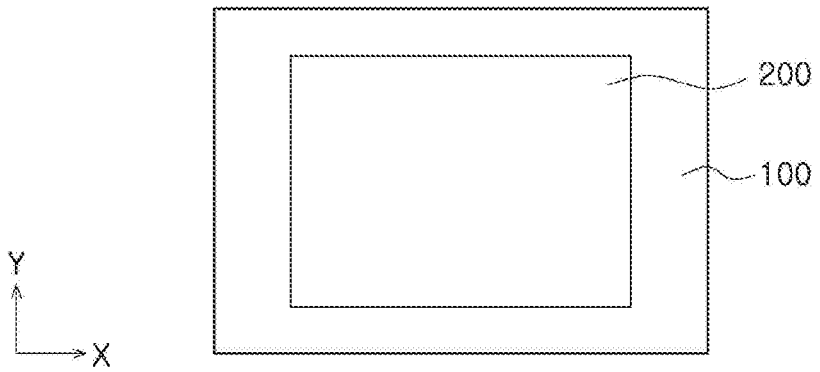
FIGS. 4A to 4F are views schematically illustrating a process of manufacturing a resistor component according to an exemplary embodiment.
Figure 4B:
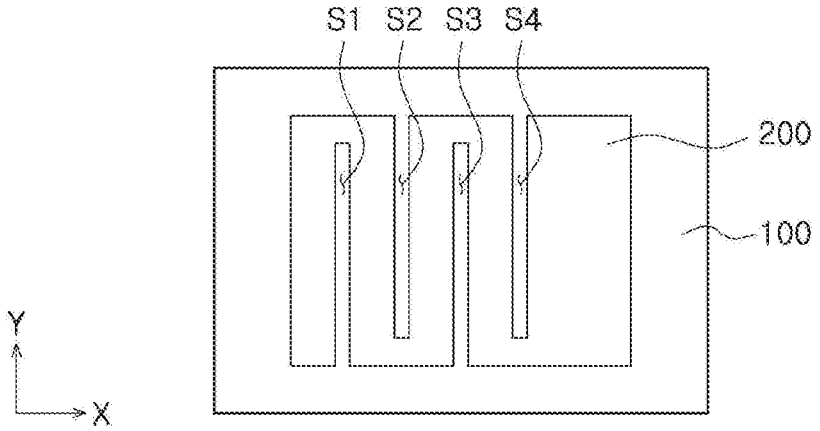

Referring to FIG. 4A, a paste for the formation of the resistive layer 200 is printed on the first surface 101 of the support substrate 100. Referring to FIG. 4B, after drying the paste for the formation of the resistive layer 200, the dried paste for the formation of the resistive layer 200 is trimmed to form primary slits S1, S2, S3 and S4. The trimming process is a process of adjusting a resistance value of the resistor component by measuring the resistance value of the resistor component while forming a slit in the resistive layer or the paste for the formation of the resistive layer and stopping the formation of the slit when the resistance value approaches a desired resistance value. Accordingly, the resistance value of the resistor component according to this embodiment may be precisely controlled. The slits S1, S2, S3, S4 and S5 may be formed in the paste for the formation of the resistive layer 200 through laser processing, for example, but the process is not limited thereto. The inner wall of the resistive layer 200 forming the inner walls of the primary slits S1, S2, S3 and S4 may be formed to be perpendicular to the support substrate 100 by such laser processing.

Figure 4C:
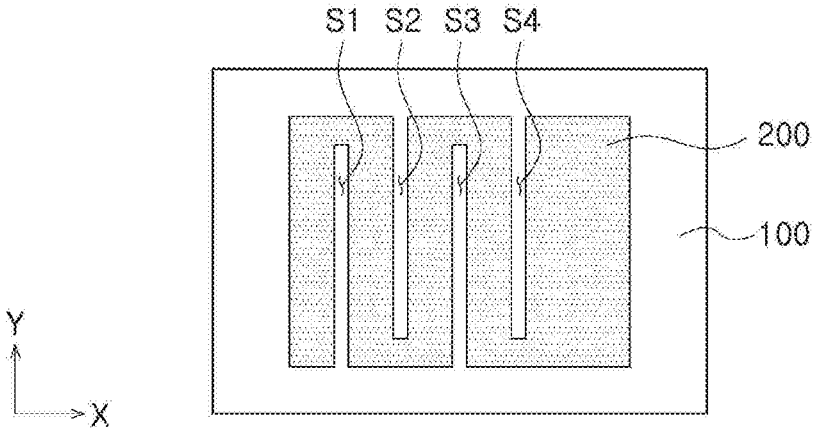

Referring to FIG. 4C, the resistive layer 200 is formed by sintering the paste for the formation of the resistive layer 200, in which the primary slits S1, S2, S3 and S4 have been formed. In the case of a general resistor component, the slit may be formed on the resistive layer after applying a paste for the formation of a resistive layer to a support substrate and sintering the paste. In this case, cracks may be formed in the periphery of the slit in the resistive layer due to the fluidity of the paste for the formation of the resistive layer and diffusion and grain growth of the paste during sintering. On the other hand, in this embodiment of the present disclosure, before sintering of the resistive layer 200, for example, by forming the primary slits S1, S2, S3 and S4 in the paste for the formation of the resistive layer 200 in a dry condition, a problem of occurrence of excessive cracking in the resistive layer 200 may be prevented.

Figure 4D:
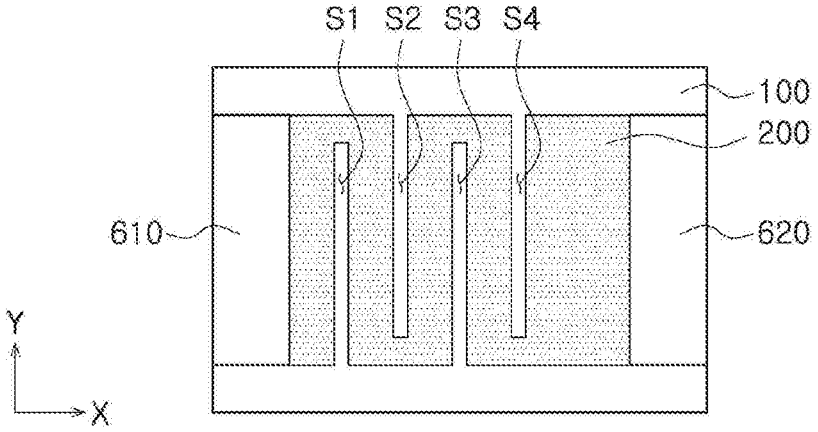

Referring to FIG. 4D, first and second internal electrodes 610 and 620 are formed on the third surface 103 and the fourth surface 104 of the support substrate 100, respectively. The first and second internal electrodes 610 and 620 may be extended onto the first surface 101 or the second surface 102 of the support substrate 100. Referring to FIG. 2, the first and second internal electrodes 610 and 620 may also be disposed to partially cover the resistive layer 200 disposed on the first surface 101 of the support substrate 100. The first and second internal electrodes 610 and 620 may be formed by applying a conductive paste containing a metal powder such as copper (Cu), silver (Ag), or nickel (Ni), a binder, and a glass component, followed by sintering thereof.

Figure 4E:
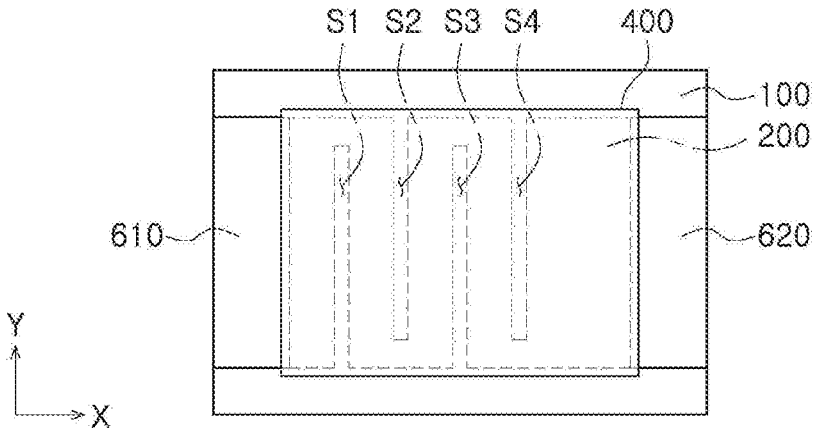

Referring to FIG. 4E, the first protective layer 400 is printed on the resistive layer 200 in which the primary slits S1, S2, S3 and S4 have been formed, and the printed first protective layer 400 is sintered. Since the first protective layer 400 may include glass as described above, a sintering temperature of the first protective layer 400 may be lower than a sintering temperature for the formation of the resistive layer 200 or a sintering temperature for the formation of the first and second internal electrodes 610 and 620.

Figure 4F:
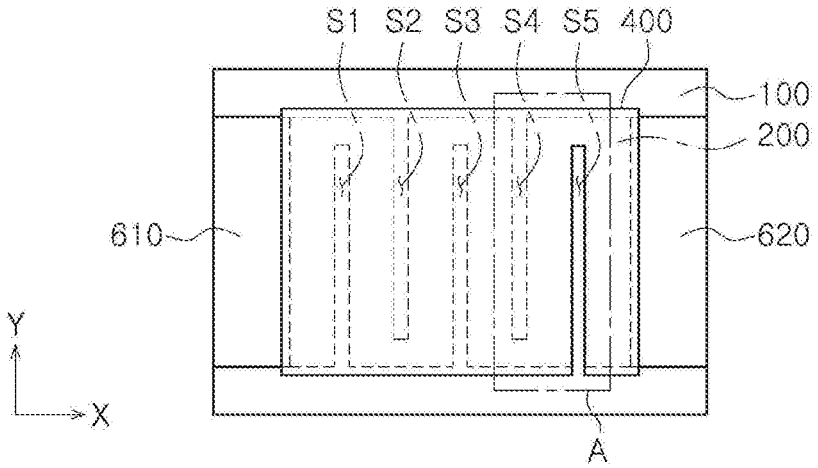

Referring to FIG. 4F, the secondary slit S5 simultaneously penetrating through the first protective layer 400 and the resistive layer 200 is formed. For example, the secondary slit S5 is formed to extend through the first protective layer 400. As a result, a width of the secondary slit S5 formed in the resistive layer 200 and a width of the secondary slit S5 extending to the first protective layer 400 may correspond to each other. In addition, as the secondary slit S5 is also formed by laser processing, the inner wall of the resistive layer 200 and the inner wall of the first protective layer 400 that form the inner wall of the secondary slit S5 are formed to be vertical (e.g., orthogonal to the first surface 101 of the support substrate 100). Referring to FIG. 2, a thickness T2 of the secondary slit S5 may be greater by a separation distance between an upper surface of the resistive layer 200 and an upper surface of the first protective layer 400, than a thickness T1 of each of the primary slits S1, S2, S3 and S4.

Figure 5:
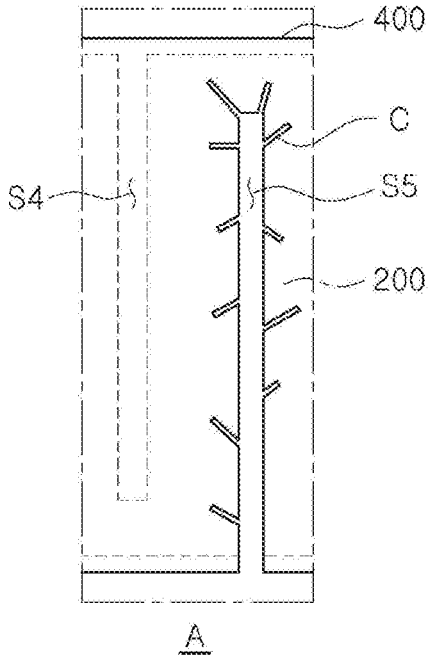
FIG. 5 is a view schematically illustrating cracks of secondary slit compared to the primary slit.

In performing a trimming process of a general resistor component, a slit is formed after a resistive layer and a first protective layer are formed by sintering. In this case, a problem in which a fine crack is formed in the periphery of the slit of the first protective layer may occur due to a glass component included in the first protective layer. Therefore, in this embodiment, the trimming process is performed by a pre-process of forming a plurality of primary slits S1, S2, S3 and S4 in the paste for the formation of the resistive layer 200 before sintering, and a post process of forming the secondary slit S5 in the first protective layer 400. As a result, referring to FIG. 5, cracks C in the periphery of the primary slits S1, S2, S3 and S4 formed in the resistive layer 200 may be formed less, compared to cracks in the periphery of the secondary slit S5 formed in the resistive layer 200 or the first protective layer 400. Further, during the trimming process, a problem such as the occurrence of cracks in the periphery of the slits S1, S2, S3, S4 and S5 of the resistive layer 200 or the first protective layer 400 may be significantly reduced.

Modification of One Embodiment

Figure 6:
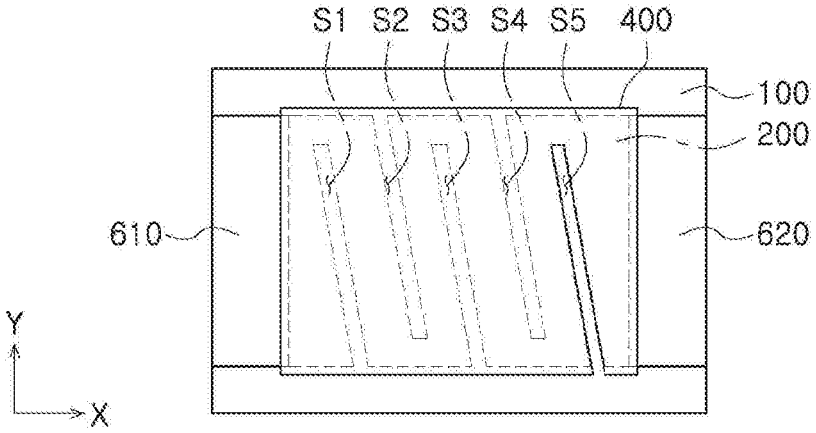
FIG. 6 is a plan view schematically illustrating a resistor component according to a modification of an exemplary embodiment.

FIG. 6 is a plan view schematically illustrating a resistor component according to a modification of an exemplary embodiment. On the other hand, for convenience of description, in the illustration of FIG. 6, the second protective layer and the first and second external electrodes are omitted.

A resistor component according to the modification has a difference in that the direction in which the slits extend is different from that in the resistor component 1000 according to the foregoing embodiment. Therefore, in the description of this modification, only the extension direction of the slits different from that in the foregoing embodiment will be described. The rest of the configuration of this embodiment may be applied as described in the exemplary embodiment.

Referring to FIG. 6, a direction in which the plurality of slits S1, S2, S3, S4 and S5 extend may not be parallel to the first direction Y of the resistive layer 200. For example, a direction in which a plurality of slits S1, S2, S3, S4 and S5 extend from one end and the other end facing each other in the first direction Y may not be parallel to the first direction Y, and may not be perpendicular to the second direction X. For example, a direction in which the plurality of slits S1, S2, S3, S4 and S5 extend may form an acute angle with the first direction Y, such as an angle ranging from 1-89 degrees relative to the first direction Y. For example, the direction in which the plurality of slits S1, S2, S3, S4 and S5 extend may have an oblique shape, and the shape thereof is not limited to a specific shape.

As set forth above, according to an exemplary embodiment, a resistance value of a resistive layer of a resistor component may be more precisely controlled.

Further, according to an exemplary embodiment, the rated power characteristics of a resistor component may be improved.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed to have a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A resistor component comprising:

a support substrate;

a resistive layer disposed on one surface of the support substrate;

a plurality of slits disposed in the resistive layer, each extending from one end or another end of the resistive layer opposing each other in a first direction, and spaced apart from each other in a second direction traversing the first direction;

first and second internal electrodes disposed on the support substrate and respectively disposed on one end and another end of the resistive layer opposing each other in the second direction to be spaced apart from each other; and a first protective layer disposed on the resistive layer, wherein the plurality of slits include a primary slit covered by the first protective layer, and a secondary slit extending in the first protective layer, and each slit among the primary slit and the secondary slit extends in the first direction with a constant width from the one end or the other end of the resistive layer to at least a mid-point of the slit.

2. The resistor component of claim 1, wherein the secondary slit is spaced apart from all other slits of the plurality of slits and is disposed such that all the other slits are to one side thereof in the second direction.

3. The resistor component of claim 1, wherein the primary slit includes a plurality of primary slits, primary slits among the plurality of primary slits that extend to the one end of the resistive layer in the first direction are disposed alternately, in the second direction, with primary slits that extend to the other end of the resistive layer in the first direction, and the secondary slit extends to the one end of the resistive layer and is disposed adjacent to a primary slit that extends to the other end of the resistive layer.

4. The resistor component of claim 1, wherein the first protective layer is disposed inside the primary slit to be in contact with an inner wall of the primary slit and the one surface of the support substrate exposed through the primary slit.

5. The resistor component of claim 1, wherein the first protective layer comprises glass.

6. The resistor component of claim 1, wherein a width of the secondary slit in the resistive layer is equal to a width of the secondary slit in the first protective layer.

7. The resistor component of claim 1, wherein a wall of the resistive layer forming an inner wall of the primary slit is perpendicular to the one surface of the support substrate.

8. The resistor component of claim 1, wherein a wall of the resistive layer forming an inner wall of the secondary slit, and a wall of the first protective layer, are perpendicular to the one surface of the support substrate.

9. The resistor component of claim 1, wherein a thickness of the secondary slit is greater by a separation distance between an upper surface of the resistive layer and an upper surface of the first protective layer, than a thickness of the primary slit.

10. The resistor component of claim 1, wherein the plurality of slits extend in a direction parallel to the first direction.

11. The resistor component of claim 1, wherein the plurality of slits extend in a direction not parallel to the first direction.

12. The resistor component of claim 1, wherein a portion of the resistive layer adjacent to the primary slit has less cracks than a portion of the resistive layer or the first protective layer adjacent to the secondary slit.

13. The resistor component of claim 1, wherein the first protective layer is disposed on the first and second internal electrodes to cover portions of the first and second internal electrodes.

14. The resistor component of claim 1, further comprising a second protective layer disposed on the first protective layer and filling the secondary slit.

15. A resistor component comprising:

a support substrate;

a resistive layer disposed on one surface of the support substrate, and having a plurality of slits extending therethrough; and a first protective layer disposed on the resistive layer and extending in at least one slit of the plurality of slits, wherein at least another slit of the plurality of slits is free of the first protective layer therein, and each slit of the plurality of slits extends with a constant width from one of two opposing edges of the resistive layer in a direction parallel to the one surface of the support substrate.

16. The resistor component of claim 15, wherein the first protective layer has at least one slit that extends therethrough and that is aligned with the at least another slit of the first protective layer.

17. The resistor component of claim 15, further comprising:

a second protective layer having a composition different from the first protective layer, disposed on the first protective layer, and extending in the at least another slit.

18. The resistor component of claim 17, wherein the second protective layer contacts the support substrate through the at least another slit.

19. The resistor component of claim 15, further comprising:

first and second internal electrodes disposed on opposing ends of the resistive layer; and first and second external electrodes covering the first and second internal electrodes, respectively.

20. The resistor component of claim 19, wherein the first protective layer is disposed between the first internal electrode and the first external electrode, and between the second internal electrode and the second external electrode.

* * * * *